United States Patent [19]

Kobori et al.

[11] Patent Number: 4,799,339

[45] Date of Patent: Jan. 24, 1989

[54] METHOD OF CONTROLLING BUILDING AGAINST EARTHQUAKE

[75] Inventors: Takuji Kobori; Hiroo Kanayama; Mitsuo Sakamoto; Shunichi Yamada; Shuichi Kamagata, all of Tokyo, Japan

[73] Assignee: Kajima Corporation, Tokyo, Japan

[21] Appl. No.: 49,656

[22] Filed: May 13, 1987

[30] Foreign Application Priority Data

May 16, 1986 [JP] Japan ..... 61-112025
May 16, 1986 [JP] Japan ..... 61-112026

[51] Int. Cl.[4] ..... E04B 1/98
[52] U.S. Cl. ..... 52/1; 52/167
[58] Field of Search ..... 52/1, 167

[56] References Cited

U.S. PATENT DOCUMENTS 4,635,892 1/1987 Baker ..... 52/167

FOREIGN PATENT DOCUMENTS 205036 11/1984 Japan ..... 52/167

*Primary Examiner*—J. Karl Bell
*Attorney, Agent, or Firm*—James H. Tilberry

[57] ABSTRACT

A method of controlling a building against an earthquake according to the present invention comprises the steps of analyzing instantly the earthquake on the basis of data observed by earthquake sensors disposed in the building and narrow and wide regions, varying the connecting conditions in the building on the basis of obtained earthquake response forecast to vary the rigidity of the building or giving counter force to a building with an exciter to control oscillation according to individual earthquake characteristics.

19 Claims, 8 Drawing Sheets

1
5a
6
A
A 11
11

11
11

5a
11

METHOD OF CONTROLLING BUILDING AGAINST EARTHQUAKE

BACKGROUND OF THE INVENTION

1. Field of the Invention

This invention relates to a method of controlling a building against an earthquake, comprising the steps of utilizing an earthquake observing network and a communication network when an earthquake happened to adjust positively the rigidity of a building itself by a control device or giving exciting force for cancelling a seismic oscillation input to the building in the opposite direction, thereby preventing the building from damages due to resonance phenomena.

2. Description of the Prior Art

Conventionally, in earthquake-proof designs of multistoried buildings, important structures or the like have been calculated the movement of foundation and the response of buildings when on earthquake happened to carry out the dynamic design for checking the safety.

For the earthquake-proof method are employed a quake avoiding or reducing method in which laminated rubber supports and dampers are interposed between the building and the foundation, a method of consuming the seismic energy through the breakage of non-main members of building contituents, a method of providing slits in walls, pillars or the like to adjust the building to the optimum rigidity.

Also, the present applicant has already developed the quake avoiding and resisting system which controls a trigger device interposed connectively or releasably between the building and the foundation side base by utilizing the earthquake observing network and communication network (see Japanese Patent Laid-Open No. Sho 62-63776).

Now, the safety of buildings designed by the current quake resisting design method in an earthquake is confirmed on the basis of the fundamental concept that the absorbing energy due to hysteresis characteristics accompanied by the plasticization of structure exceeds the seismic energy acting on the structure. However, the above case presents a problem of reliability on hysteresis loop characteristics.

Further, all conventional methods except for the method by said application give the quake resisting structures passive to the natural external forces such as earthquake, wind or the like so that the resonance phenomena to an uncertain input of earthquake cannot be avoided since a building has a specific natural frequency.

SUMMARY OF THE INVENTION

The present invention aims to give the safety of buildings and apparatus, residents, etc. in the building, not by said passive earthquake-proof methods, but by a method of varying the rigidity of a building itself under the judgement of response forecasting system based on the sensed seismic oscillation, i.e., varying the natural frequency of the building to provide the condition having no or few resonance regions or by another method of applying exciting force to the building in the opposite direction under the judgement of said response forecasting system to restrain the resonance.

With a method of controlling a building against an earthquake according to the present invention, connectors varying the connecting condition according to the command of a control device using a computer are placed between pillars, beams, braces, walls and all or a portion of these connections, or between the building and the base or adjacent building to control the buildings against the earthquake as follows;

(1) The occurrence of earthquake is sensed by quake sensors disposed in narrow and wide regions centering around the building to transmit observed data to the control device through wire and wireless communication networks. The quake sensors in the wide region are connected to seismographs placed at existing quake observing spots or ones installed exclusively through microcircuits, telephone circuit or the like. Also, the quake sensors in the narrow region consist of seismographs placed around the building or in the peripheral foundation and oscillation sensors installed in the building and on the base thereof. The effect of wind power or the like is sensed through the oscillation sensors in the building.

(2) The computer in the control device judges the magnitude of sensed earthquake, analyzes frequency characteristics and forecasts the responsive amount. Subsequently, it is judged whether or not the oscillation of the building should be controlled. Further, control amount in the case to be controlled is judged as what avoids the resonance to give an optimum rigidity (natural frequency) having small seismic responsive amount.

(3) The command of the control device is transmitted to the connectors placed at each section of the building to operate the connectors such that the rigidity of the building provides an optimum one based upon the forecast of the control device. The connecting condition is adjusted by adjusters proposed to adjust the fixed and connection releasing conditions by turning on and off a hydraulic mechanism, electromagnet, or the like and adjust the introduction of tensile force and the fixation at any position in addition to the fixed and connection releasing conditions by making use of the hydraulic mechanism or special alloys or the like.

Further, the responsive amount in each section of the building and the actual oscillation when effecting control operation can be detected by the oscillation sensors disposed in the building to be fed back for correction of control amounts or the like.

With another method according to the present invention, an exciter consisting of an additional mass oscillated with required frequency according to the command of the control device and a drive mechanism is installed in the building or the top thereof to control the building against the earthquake as follows:

(1) The occurrence of earthquake is detected by quake sensors disposed in narrow and wide regions centering around the building to transmit observed data to the control device through wire and wireless communication networks. The quake sensors in the wide region are connected to seismographs placed at existing quake observing spots or ones installed exclusively through micro circuits or telephone circuits or the like. Further, the quake sensors in the narrow region consist of seismographs placed around the building or in the peripheral foundation and oscillation sensors installed in the building and on the base thereof. The effect of wind power or the like is sensed through the oscillation sensors in the building.

(2) The computer in the control device judges the magnitude of sensed earthquake, analyzes frequency characteristics and forecasts responsive amount. Subsequently, it is judged whether or not the oscillation of the building should be controlled. With reference to the control amount in the case to be controlled, the frequency and direction are calculated to cancel the seismic oscillation input with exciting force applied to the building by the exciter and thus minimize the response to the building.

(3) The command of the control device is transmitted to the exciter to give the exciting force corresponding to the seismic oscillation input to the building. This exciting force will suffice to restrain the resonance of the building and give to the building the force having the same magnitude and opposite direction with the natural frequency producing the resonance, for example.

For the exciter are proposed one oscillated by an actuator supported by roller bearings, for example, and having an additional mass block connected to a portion of the building body through an elastic member like a spring to be controlled by the control device, one oscillated by changing the direction of electromagnetic force or the like.

Further, the present invention does not hinder the use of said method in combination with prior quake avoiding and attenuating methods, but permits said method to be used in combination with these methods for improving the safety and economy.

Also, the quake observing network and communication network can utilize the existing facilities and be held jointly at a plurality of buildings, thereby reducing the expenses of the facilities.

OBJECTS OF THE INVENTION

An object of the present invention is to judge data sensed by quake sensors disposed in narrow and wide regions instantly by a computer in a control device and vary the rigidity of a building itself at will on the basis of the responsive forecast to provide an optimum condition free from resonance according to individual earthquake characteristics.

Another object of the present invention is to cancel resonation components and minimize the effect of an earthquake to a building according to individual earthquake characteristics by judging instantlty data sensed by quake sensors disposed in narrow and wide regions with a computer in a control device and giving to the building oscillation in the opposite direction to seismic force on the basis of the responsive forecast.

A further object of the present invention is to ensure the safety of a building, apparatus and residents in the building and attend the business in the building under the tranquil condition according to said methods.

The above-mentioned and other objects and features of the invention will become apparent from the following detailed description taken in conjunction with the drawings which indicate embodiments of the invention.

DESCRIPTION OF THE PREFERRED EMBODIMENTS

Figure 1:
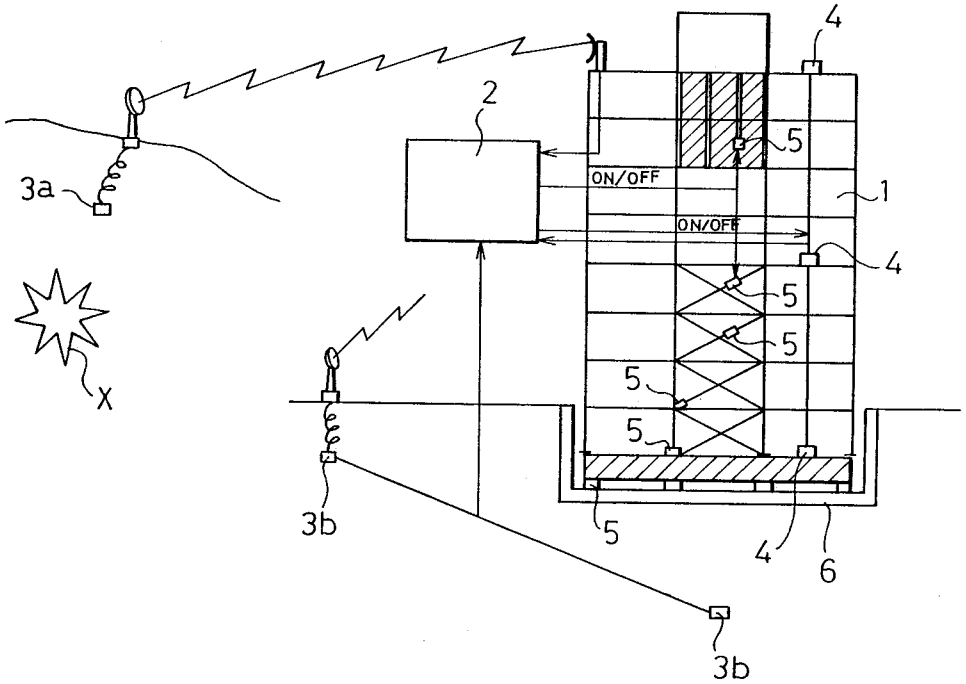
FIG. 1 is a schematic view showing the outline of an embodiment according to the present invention.
Figure 2:
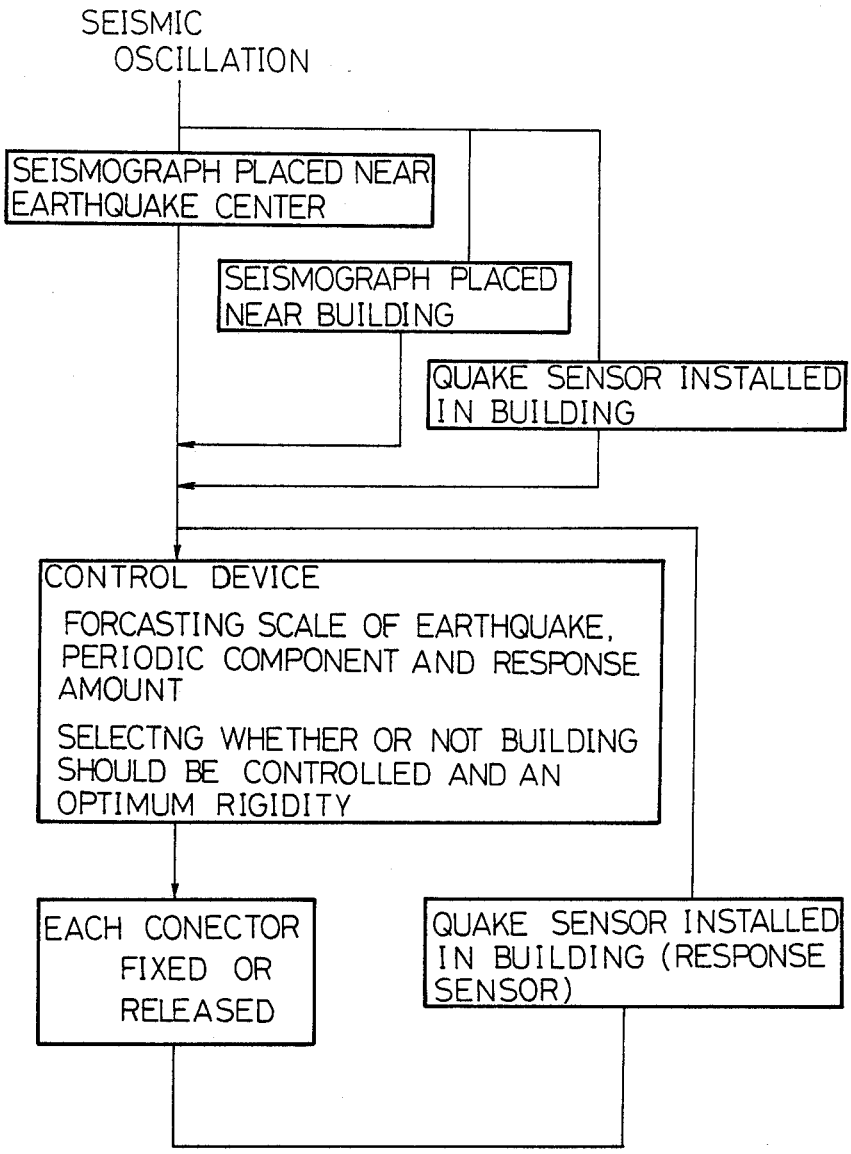
FIG. 2 is a block diagram showing the embodiment shown in FIG. 1.
Figure 3A:
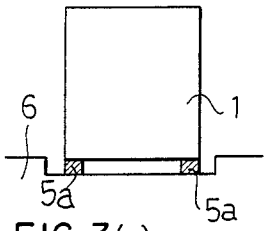
FIGS. 3(*a*) to 3(*g*) are sectional views showing patterns of connector installing positions.
Figure 3B:
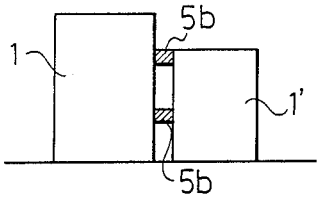
Figure 3C:
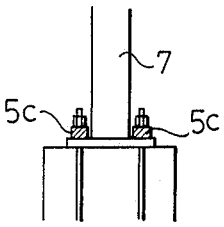
Figure 3D:
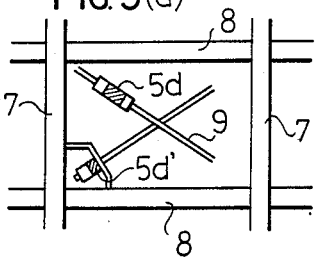
Figure 3E:
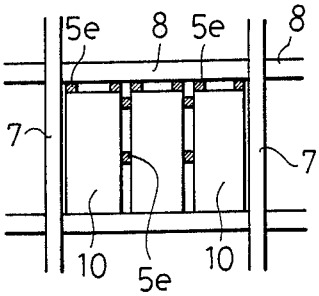
Figure 3F:
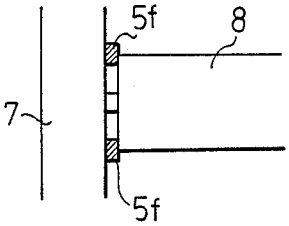
Figure 3G:
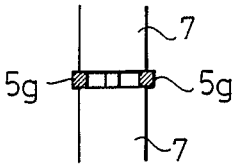

Referring to FIG. 1 showing the outline of an embodiment according to the present invention together with FIG. 2 showing the block diagram, seismic oscillation sensed by a seismograph 3*a* in a quake observing network disposed in a wide region and near a seismic center X, a seismograph 3*b* centering a building 1 and in the proximity thereof and further a quake sensor 4 or the like installed in the building 1 is sent to the input of a control device 2 (which is usually a computer installed in the building 1). When the scale of earthquake is judged to exceed a certain allowable value from the oscillatory acceleration or the like of the earthquake, the control device 2 measures the acceleration, analyzes the frequency characteristics, and calculatively forecasts the oscillatory property, displacement or the like of the building. When these values are also assumed to exceed a certain allowable value, an amount of change in rigidity due to changing the connected condition of a connector 5 is examined to determine an optimum rigidity for avoiding the resonance accompanying the quake oscillation within the range of maintaining the function as a structure. To this calculable forecast can be applied a quake response analyzing means utilizing the definite element method or the like which is employed generally. In this case, the computer judges instantly the situation and sends the commands to the respective connectors 5 to change the rigidity of the building 1.

Referring to the numerical example of the seismograph 3*a* disposed in the wide region, assuming that the earthquake center X, the seismograph 3*a* and the building 1 to be controlled are aligned on a straight line and spaced 50 Km from each other respectively, about 18.5 seconds are taken from the detection of P wave to the motion of S wave and about 12 seconds are taken from the detection of S wave to the motion of S wave. Therefore, the completion of control during such seconds will suffice for changing the rigidity. Also, referring to the seismograph 3*b* in the narrow region, when the distance between the earthquake center X and the seismograph 3*b* is 100 Km, about 12 seconds are taken from the detection of P wave to the motion of S wave and thus the completion of control during such seconds will suffice.

Also, the actual response after the rigidity has been changed is sensed by the quake sensor 4 in the building 1 to be fed back for correction.

FIGS. 3(*a*) to (*g*) show the patterns of positions in which the connectors 5 are installed and the following connectors are considered and combined with each other to cope with earthquakes;

(1) Connectors 5a between the building 1 and the base 6

(2) Connectors 5b interposed between the building 1 and adjacent buildings 1'

(3) Connectors 5c interposed between anchors of legs or pillar 7

(4) Connectors 5d,5d' in members of brace 9 or on ends of the braces 9

(5) Connectors 5e in quake resisting walls 10

(6) Connectors 5f in the connection between pillar 7 and beam 8

(7) Connectors 5g in the members of pillar 7.

Figure 4:
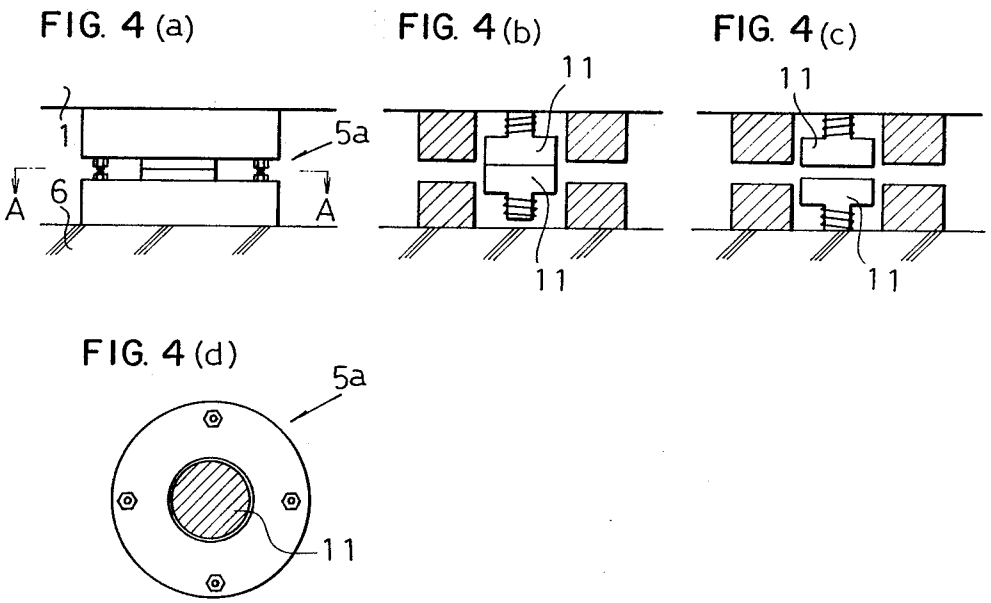
FIGS. 4(*a*) to 4(*d*) are a side view showing a connector using an electromagnet, a sectional view showing the connecting condition, a sectional view showing the released condition and a sectional view taken along the line A—A, respectively.

FIGS. 4(*a*) to (*d*) show the connectors 5a between the building 1 and the base 6 utilizing an electromagnet 11 to operate the electromagnet 11 according to the command of the control device so that the fixed condition (FIG. 4(*b*)) and the connection releasing condition (FIG. 4(*c*)) can be provided. This construction is suitable for use in combination with the quake avoiding device using laminated rubber.

Figure 5:
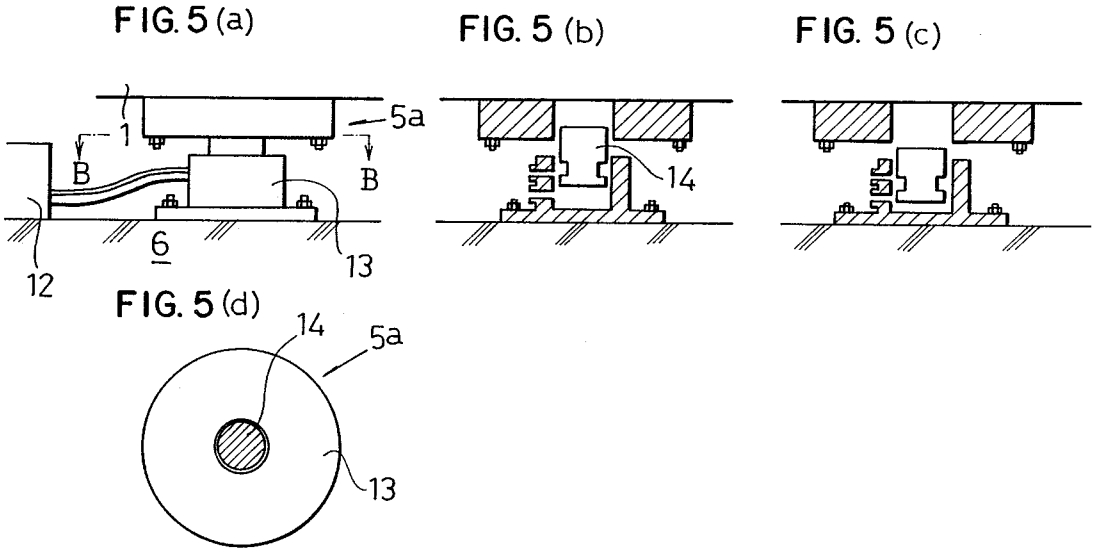
FIGS. 5(*a*) to 5(*d*) are a side view showing a connector using a hydraulic cylinder, a sectional view showing the connecting condition, a sectional view showing the released condition and a sectional view taken along the line B—B, respectively.

FIGS. 5(*a*) to (*d*) show the connectors between the building 1 and the base 6 utilizing a hydraulic cylinder 13 to provide the fixed condition (FIG. 5(B)) and the connection releasing condition (FIG. 5(*c*)). In the drawing, reference numeral 12 designates an electrohydraulic pump.

Figure 6B:
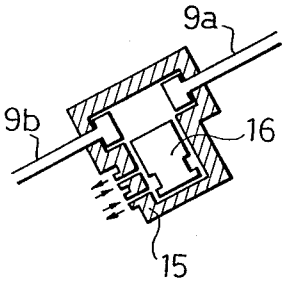
FIGS. 6(*a*) and 6(*b*) are sectional views showing the connecting and released conditions of the connector between brace members using hydraulic cylinders, respectively.
Figure 6A:
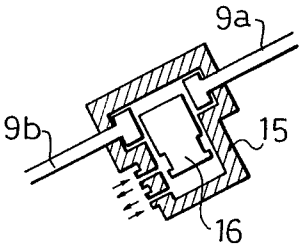

FIGS. 6(*a*) and (*b*) show an example of the connectors 5d interposed between members 9a,9b of the brace 9 and changed between the fixed condition (FIG. 6(*a*)) and the connection releasing condition (FIG. 6(*b*)) by the movement of a piston 16 in a hydraulic cylinder 15.

Figure 7:
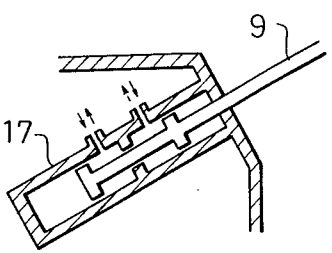
FIG. 7 is a sectional view showing the connector provided on an end of the brace.

FIG. 7 shows an example of the connector 5d' on an end of the brace 9. The end of the brace 9 is moved in a cylinder 17 by oil pressure to provide not only the fixed and released conditions, but also the tensioned condition of the brace 9 or the like.

While the embodiments in case when changing the rigidity of a building itself have been heretofore described, next will be described embodiments in which the seismic oscillation input is cancelled by counter force due to exciter.

Figure 8:
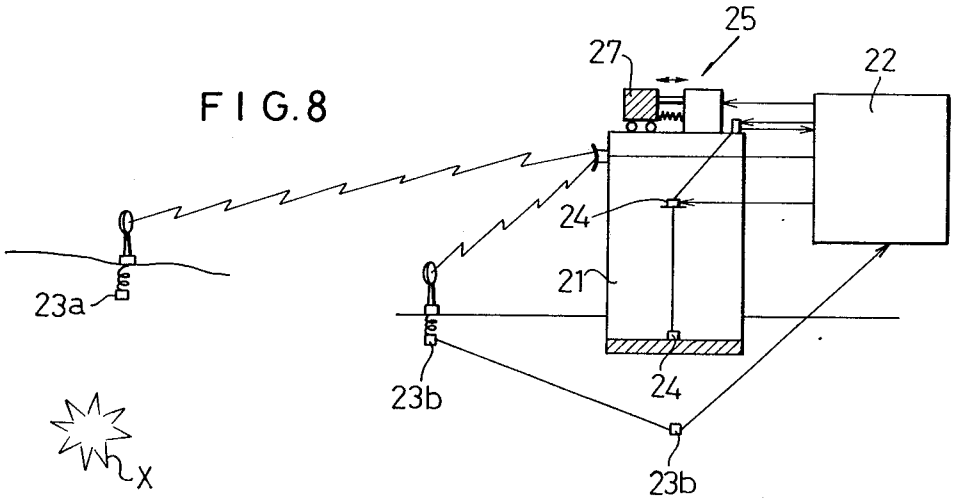
FIG. 8 is a schematic view showing the outline of another embodiment according to the present invention.
Figure 9:
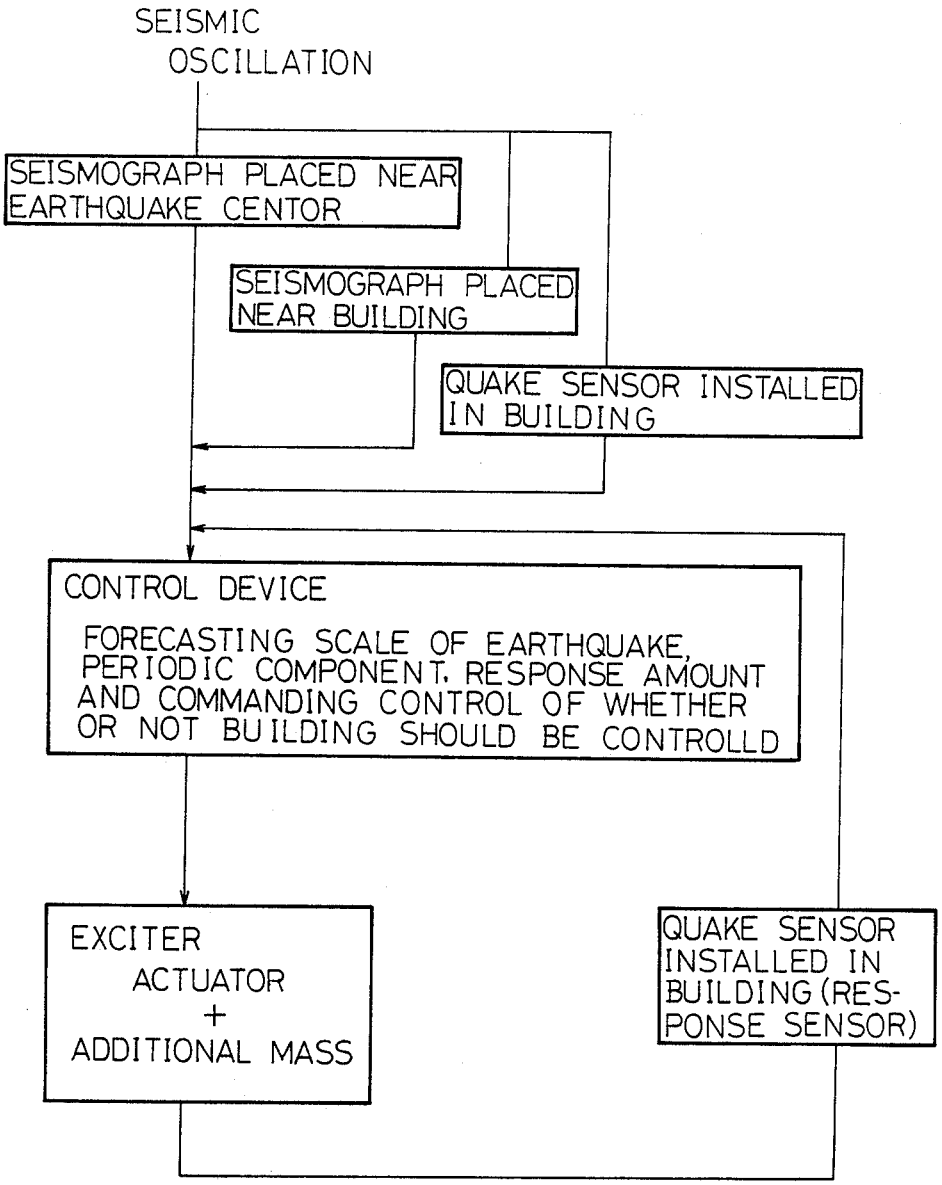
FIG. 9 is a block diagram of the embodiment shown in FIG. 8.

FIG. 8 shows the outline of a second embodiment. Referring to FIG. 8 together with a block diagram in FIG. 9, the earthquake oscillation sensed by a seismograph 23a near the earthquake center X in the earthquake observing network disposed in a wide region, a seismograph 23b centering the building 1 and in the proximity thereof, and further a quake sensor 24 or the like installed in the building 21 is sent to the input of a control device 22 (which is usually a computer installed in the building 21). When the scale of the earthquake is judged to exceed a certain allowable value from the oscillatory acceleration or the like of the earthquake, the computer 22 measures the acceleration, analyzes frequency characteristics and calculatively forecasts the oscillatory property, displacement or the like of the building. When these value are also assumed to exceed a ertain allowable value, the control device 22 sends the command to an exciter 25 which can set the building 21 to the natural frequency in the resonance point to be forecasted of the building 21 and give oscillation in the opposite direction to the seismic input to cancel the resonating components.

Referring to the numerical example of the seismograph 23a disposed in the wide region, assuming that the earthquake center X, the seismograph 23a and the building 21 to be controlled are aligned on a straight line and spaced 50 Km from each other, about 18.5 seconds are taken from the detection of P wave to the motion of S wave and about 12 seconds are taken from the detection of S wave to the motion of S wave so that the completion of control during such seconds will suffice for the control of the building. Also, referring to the seismograph 23b in the narrow region, when the distance between the earthquake center X and the seismograph 23b is 100 Km, about 12 seconds are taken from the detection of P wave to the motion of S wave so that the completion of control commanding within such seconds will suffice for the control.

Also, the actual response is sensed by the quake sensor 24 in the building 21 and fed back for correction.

Figure 10:
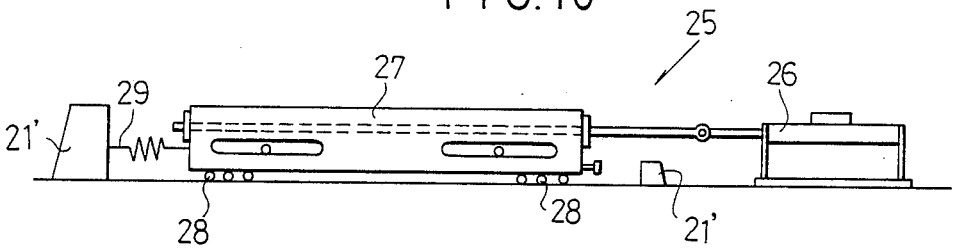
FIG. 10 is a front view showing an exciter.
Figure 11:
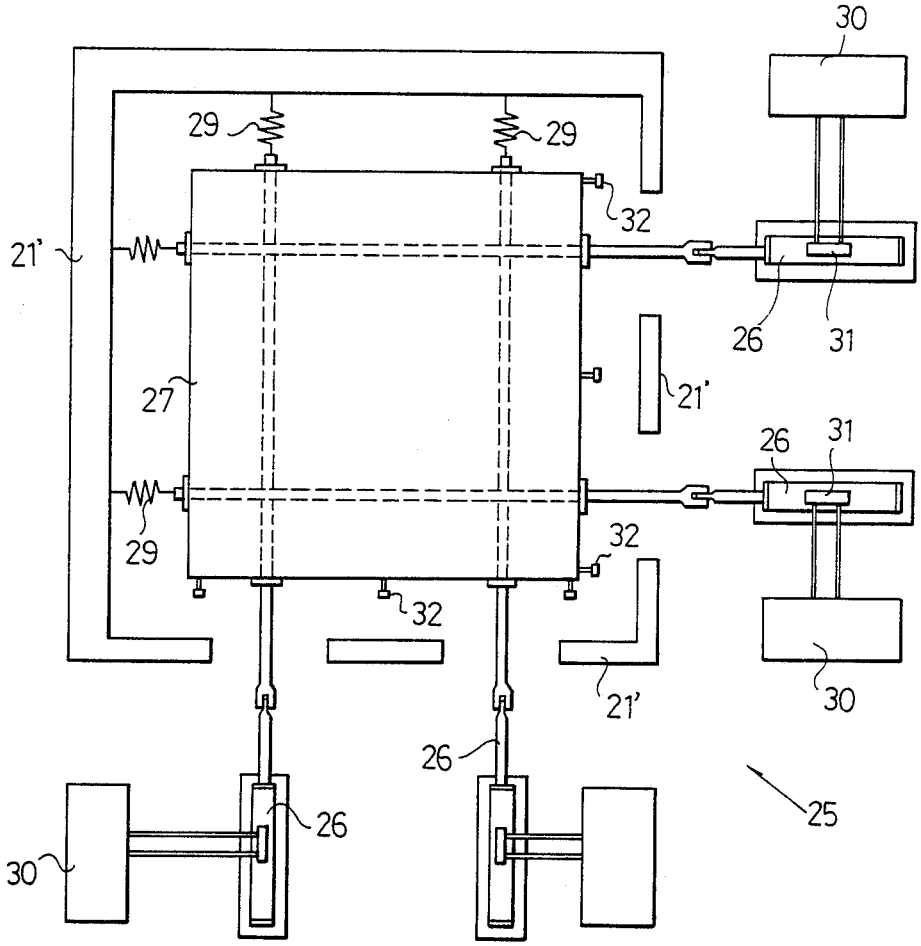
FIG. 11 is a plan view showing said exciter.

FIGS. 10 and 11 show an embodiment of the exciter 25 installed on the roof of the building 21.

That is, an additional mass block 27 supported slidably by roller bearings 28 is adapted to be oscillated by a plurality of actuators 26 fixed to the building 21. The block 27 is connected to a riser 21' on the roof through springs 29 for maintaining the neutral position so that the building is oscillated through the riser 21' by operating the actuators. Further, in the drawing, reference numeral 30 designates a hydraulic pump, 31 a servo valve, 32 a stopper for preventing the displacement from being excessively large.

The earthquake observing network, control device using the computer, exciter or the like can be applied to the existing buildings since they can be added thereto later.

What is claimed is:

1. The method of protecting an entire building against seismic tremors caused by an earthquake, comprising the steps of:

(a) sensing a seismic tremor near an earthquake center and remote from said building, before said seismic tremor reaches said building;

(b) sensing said seismic tremor in said building;

(c) analyzing said sensed tremors;

(d) providing selected structural members throughout said building with means to vary their respective rigidities; and (e) selectively varying the rigidities of said selected structural members responsive to the analysis of said tremors.

2. The method of claim 1 including the step of placing electromagnetic pads between said building and the foundation of said building and selectively energizing said electromagnetic pads responsive to said analysis of said tremors.

3. The method of claim 1 including the step of placing hydraulic jacks between said building and the foundation of said building and selectively actuting said hydraulic jacks responsive to said analysis of said tremors.

4. The method of claim 1 wherein said means to vary said respective rigidities comprises hydraulic jack means interposed between said selected structural members and the step of actuating said hydraulic jack means responsive to said analysis of said tremors.

5. The method of claim 1, including the step of exciting a seismic mass responsive to the said analysis of said tremors to attenuate vibrations in said building created by an earthquake.

6. The method of protecting an entire building against seismic tremors caused by an earthquake, comprising the steps of:

(a) sensing a seismic tremor near an earthquake center and remote from said building;
(b) sensing said seismic tremor in said building;
(c) transforming said sensed tremors into electronic signals;
(d) relaying said electronic signals to a control device adapted to analyze said signals and to emit electronic commands responsive to the analysis of said signals;
(e) providing selected structural members throughout said building with means to vary their respective rigidities responsive to commands received from said control device; and
(f) varying the rigidity of said structural members responsive to said commands to change the natural frequency of the building, whereby the destructive effect of seismic tremors on the building are attenuated by the commanded changes in the rigidities of said structural members.

7. The method of protecting an entire building against seismic tremors caused by an earthquake, comprising the steps of:
(a) sensing a seismic tremor near an earthquake center;
(b) sensing said seismic tremor intermediate said earthquake center and a building to be protected;
(c) sensing said seismic tremor in said building;
(d) converting said sensed tremors into electronic signals;
(e) relaying said electronic signals to a control device adapted to analyze said signals and to emit electronic commands responsive to the analysis of said signals; and
(f) exciting said building responsive to said commands at a frequency equal and opposite to the frequency of the seismic tremor to cancel the effect of the seismic tremor on the building.

8. The method of claim 7, wherein the step of exciting the building includes the step of using a movable mass in association with said building, and the step of oscillating said movable mass.

9. The method of protecting an entire building against seismic tremors caused by an earthquake, comprising the steps of:
(a) sensing a seismic tremor at the site of the origin of the tremor;
(b) converting said sensed tremor into an electronic signal; and
(c) relaying said electronic signal to a control device adapted to analyze said signal and to emit a command responsive to said signal to means adapted to offset the effect of said seismic tremor on said building.

10. The method of claim 9 wherein said means are adapted to vary the rigidity of structural members of said building.

11. The method of claim 9 wherein said means are adapted to vibrate said building at a frequency equal and opposite to the frequency of the seismic tremor.

12. The method of claim 9 wherein said means includes the use of a movable mass in association with said building, and the step of oscillating said movable mass at a frequency adapted to cancel the effect of said seismic tremor on said building.

13. The method of claim 12, wherein said movable mass is mounted on rollers, and the step of transmitting the oscillating frequency of said mass to a structural member of said building.

14. The method of claim 12, wherein said movable mass is hydraulically oscillated.

15. The method of claim 13 wherein the oscillation frequency of said mass is transmitted to said structural member of said building by the step of utilizing spring means.

16. The method of claim 12 including the step of oscillating said mass in a first back and forth motion and the step of oscillating said mass in a second back and forth motion.

17. The method of claim 16, wherein said second step is transverse to said first step.

18. The method of claim 16, wherein said first and second steps are undertaken simultaneously.

19. The method of claim 16, wherein said first and second steps are alternated.

* * * * *